United States Patent [19]

Arii et al.

[11] Patent Number: 4,637,563

[45] Date of Patent: Jan. 20, 1987

[54] TOROIDAL WINDING APPARATUS

[75] Inventors: Kazuhiro Arii; Teruaki Tanaka, both of Kobe; Nobuyuki Sumida, Sakai; Kouhei Arisaka, Takatsuki, all of Japan

[73] Assignee: Daihen Corporation, Osaka, Japan

[21] Appl. No.: 700,309

[22] Filed: Feb. 11, 1985

[30] Foreign Application Priority Data

Feb. 14, 1984 [JP] Japan ..... 59-18656[U]
Dec. 11, 1984 [JP] Japan ..... 59-187979[U]

[51] Int. Cl.[4] ..... H01F 41/08
[52] U.S. Cl. ..... 242/4 B; 242/7.13
[58] Field of Search ..... 242/4 B, 4 BE, 4 R, 242/7.13, 7.14

[56] References Cited

U.S. PATENT DOCUMENTS 1,827,186 10/1931 Borgeson ..... 242/4 B
2,430,105 11/1947 Conklin ..... 242/4 B
2,793,817 5/1957 Clarke ..... 242/4 B
3,180,583 4/1965 Dorn et al. ..... 242/4 B

FOREIGN PATENT DOCUMENTS 535153 1/1957 Canada ..... 242/4 B
13056 8/1959 Japan .
5176 2/1972 Japan .
23728 5/1983 Japan .
A115805 7/1983 Japan .
789434 1/1958 United Kingdom ..... 242/4 B

*Primary Examiner*—Billy S. Taylor
*Attorney, Agent, or Firm*—Scully, Scott, Murphy & Presser

[57] ABSTRACT

There is disclosed a toroidal winding apparatus for winding an elongated conductor such as, for example, wire strip or the like, into a coil around an enclosed trunk of a magnetic core having a central opening defined by the trunk which is comprised of a magazine for storing the conductor by winding the same around the outer periphery thereof, said magazine has an aperture provided for pulling out the stored conductor inwards in a radial direction thereof, a magazine stand for supporting the magazine rotatable around the axis thereof which has a space for setting the blank magnetic core therein to allow the magazine to rotate passing through the opening of the core, means for exerting a braking force onto the conductor passing through said aperture, a tension slider being guided movably along the periphery of the magazine, a guide means for guiding the conductor having been pulled out from the aperture, and means for biasing the tension slider in a direction along which distance between the aperture and the tension slider increases.

4 Claims, 11 Drawing Figures

TOROIDAL WINDING APPARATUS

BACKGROUND OF THE INVENTION

1. Field of the Invention

The present invention relates to a toroidal winding apparatus for forming winding wound around a trunk of a magnetic core having a central opening or window defined by the trunk.

2. Description of the Prior Art

As shown in FIG. 1 schematically, a conventional winding apparatus of this type has a circular magazine 2 which is rotatable around the center thereof passing through a central opening 1*a* of a magnetic core 1. The magazine 2 is supported rotatably by a frame (not shown) and is driven by drive means including a driving motor or a driving handle. The magazine 2 has an aperture 2*a* for pulling out the wire stored therearound which is defined by a pair of guide rollers 2*b* for guiding the wire 3 passing through the aperture.

In operation of the winding apparatus, after the core 1 is set against the blank magazine 2 as shown in FIG. 1, the magazine 2 is rotated, for instance clockwise, as shown by an arrow C in FIG. 1, to wind the wire 3 being fed from the drum means (not shown) by a predetermined length around the outer periphery thereof. The free end of the wire 3 having been wound up is pulled out inwardly through the aperture 2*a* and is fixed to the predetermined portion of the core 1. Thereafter, the magazine 2 is rotated anticlockwise, as shown by an arrow AC in FIG. 1, to form a coil having a predetermined number of turns around the trunk of the core.

In the winding appararus mentioned above, especially if the core is small size compared with that of the magazine, it is difficult to wind the wire tightly around the trunk of the core, since the wire is slacked off, as shown by dotted line in FIG. 1, during a travel of the aperture 2*a* from the position A remote from the core to the position B near to the core. This causes loose winding and, therefore, the coil is bulged to result in that the length of the wire required to form each coil becomes longer.

Also, it is to be noted that, in the winding apparatus mentioned above, the wire having been wound around the magazine is pulled out from the outer turn to the inner periphery of the magazine during forming process of the coils. Accordingly, the friction force applied to the wire being pulled out through the aperture becomes large due to the direct contact with the adjacent turns thereof and is varied due to the amount of the wire wound around the magazine. This causes uncertainty in the winding force and invites disadvantages as mentioned above.

These disadvantages in the conventional winding apparatus will be enhanced, when a thin strip of electrically conductive material is used to form a coil instead of a wire, as is disclosed in the JP-A-115805/1983.

SUMMARY OF THE INVENTION

One of the objects of the present invention is to provide a winding apparatus being capable of winding a wire, a strip or the like tightly under a constant winding force to form tight coils around the trunk of the core.

Another object of the present invention is to provide a winding apparatus being capable of unwinding a wire, a strip or the like having been wound around the magazine from the inner turn thereof substantially without any friction force.

According to the present invention, there is provided a toroidal winding apparatus for winding an elongated conductor such as, for example, wire, strip or the like, into a coil around an enclosed trunk of a magnetic core having a central opening defined by the trunk which is comprised of a magazine for storing the conductor by winding the same around the outer periphery thereof, said magazine has an aperture provided for pulling out the stored conductor inwards in a radial direction thereof, a magazine stand for supporting the magazine rotatable around the axis thereof which has a space for setting the blank magnetic core therein to allow the magazine to rotate passing through the opening of the core, means for exerting a braking force onto the conductor passing through said aperture, a tension slider being guided movably along the periphery of the magazine, a guide means for guiding the conductor having been pulled out from the aperture, and means for biasing the tension slider in a direction along which distance between the aperture and the tension slider increases.

According to the structures of the present invention, the portion of the conductor pulled out from the aperture of the magazine is kept tant owing to a tension force applied thereto by the tension slider. Therefore, the conductor can be wound around the trunk of the core tightly so as to form a tight and compact coil.

According to a preferred embodiment of the present invention, a strip is used as a conductor for forming a coil. The strip is wound into a coil around the magazine. The coiled strip is unwound from the innermost turn, when the magazine is rotated to form a coil. Therefore, the coil wound around the magazine is gradually loosened therein according to the unwinding of the strip without causing any friction between adjacent turns.

In order to guide the strip on unwinding thereof smoothly, it is desirable to arrange a plurality of bearing means along the periphery of the magazine.

BRIEF DESCRIPTION OF THE DRAWINGS

The present invention will be more fully understood and further advantages will become apparent when reference is made to the following detailed description of the accompanying drawings, in which.

DESCRIPTION OF THE PREFERRED EMBODIMENTS

Figure 1:
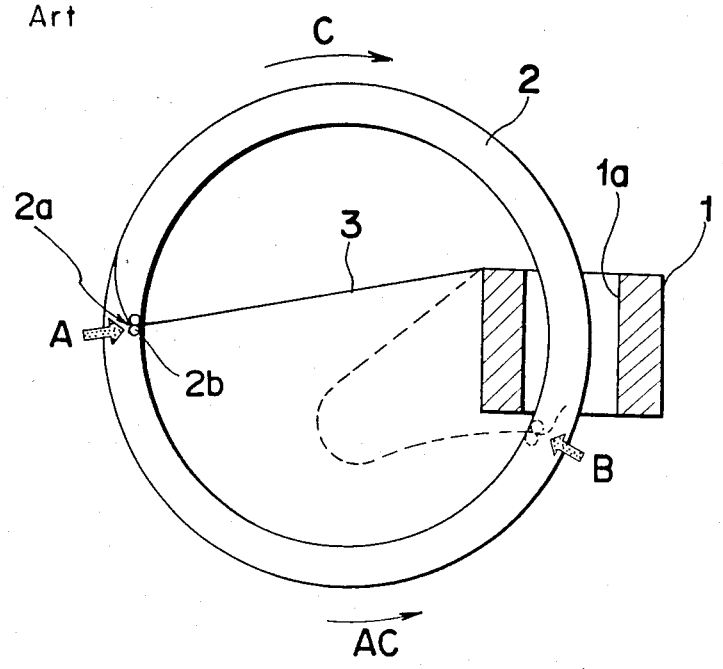
Fig. 1 Prior Art
FIG. 1 is a view schematically showing a conventional winding apparatus.
Figure 2:
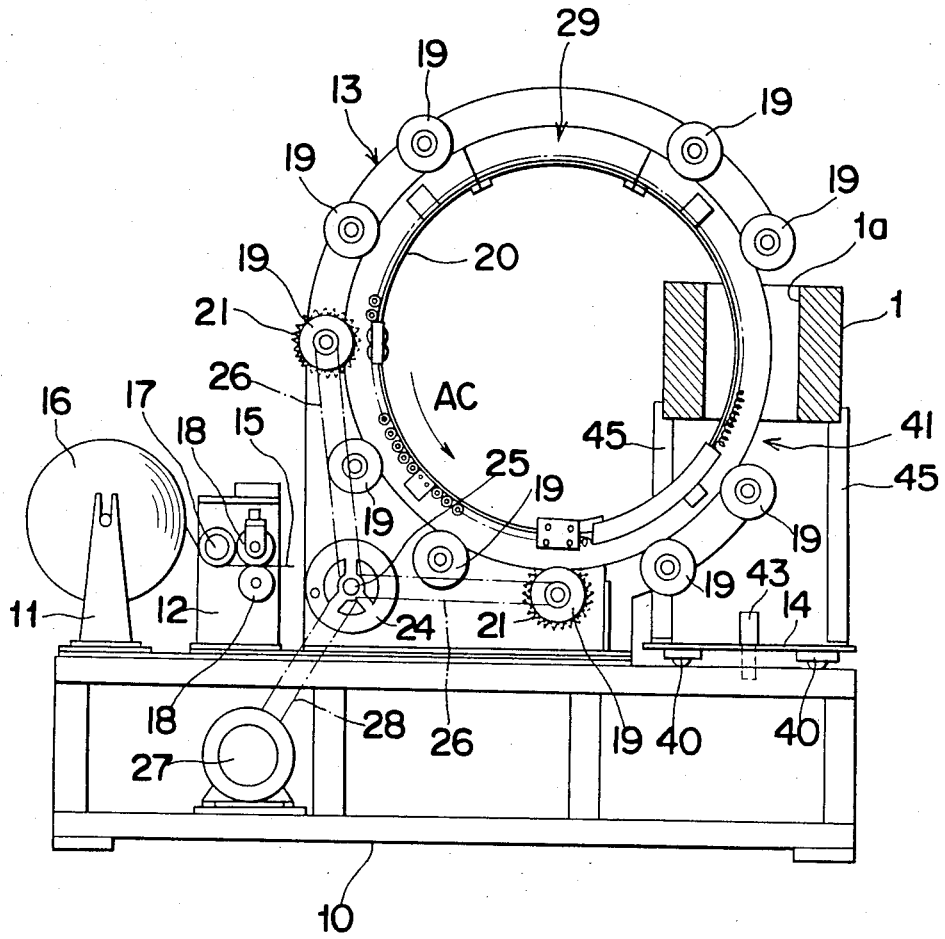
FIG. 2 is a view schematically showing a winding apparatus according to a preferred embodiment of the present invention.

Referring to FIG. 2, there are arranged a drum stand 11, a roller stand 12, a magazine stand 13 and a turn table 14 on a base frame 10 in one direction thereof. The drum stand 11 supports a feed drum 16 for feeding a strip of an electrically conductive material as a conductor.

In the roller stand 12, one guide roller 17 and a pair of feed rollers 18, 18 are mounted in order to guide the strip 15 being unwound from the drum. The feed rollers 18, 18 are arranged oppositely in a vertical direction.

Figure 3:
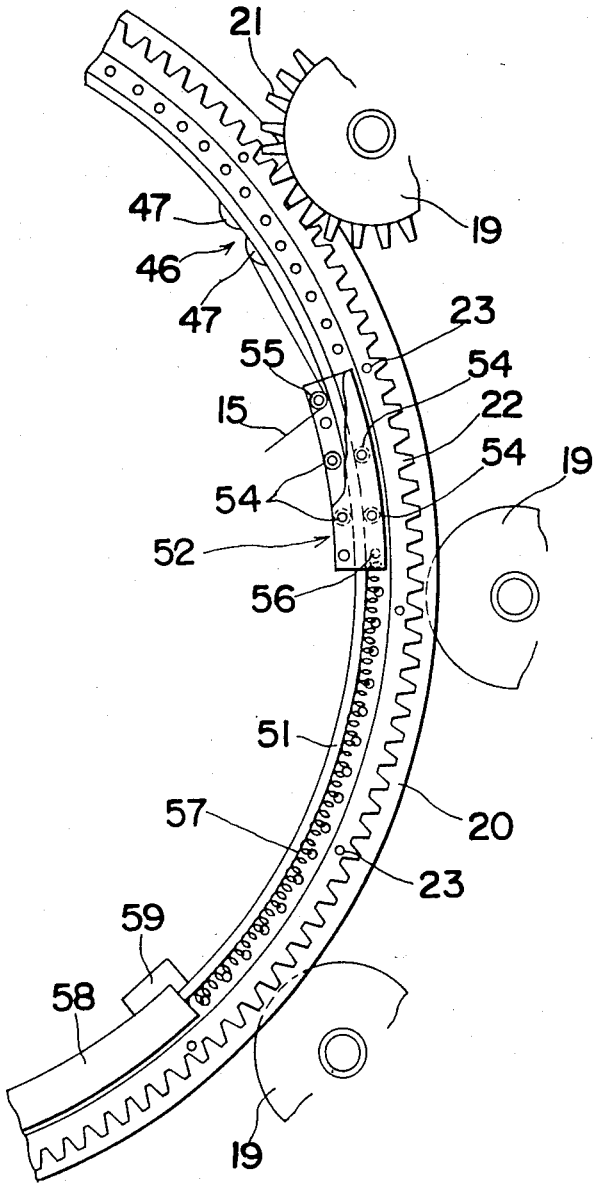
FIG. 3 is a rear view of a portion of the magazine shown in FIG. 2.

The magazine stand 13 is formed substantially in C-shape. A plurality of magazine guide rollers 19 are supported on one side of the magazine stand 13 rotatably about each axis thereof respectively and spaced with each other along a circle defined by the C-shape portion of the stand 13. These magazine guide rollers 19 co-operatively support a circular magazine 20 rotatably about its center which is disposed coaxially with the C-shape portion of the stand 13. Two drive gears 21 are respectively fixed coaxially to each rotational axis of two of magazine guide rollers on the other side of the magazine stand. Each of these guide rollers is formed to have a V-shaped groove therearound into which the outer periphery of the magazine 20 is fitted to support the magazine 20 coaxially with the C-shape magazine stand 13 as mentioned above. As shown in FIG. 3, there is arranged a driven gear 22 of a large radius on the rear side of the magazine 20 coaxially therewith. The driven gear 22 is fixed to the magazine 20 by a plurality of mounting bolts 23, 23, and is so engaged to each or two drive gears 21 as to be driven thereby.

As is shown in FIG. 2, a manually operable handle 24 is supported rotatably at the lower portion of the stand 13. Three sprocket wheel (not shown) are fixed to the rotational axis 25 of the handle 24 coaxially and spacedly with each other. Two of them are respectively coupled drivingly to a sprocket wheel by a endless chain 26 spanned therebetween, which is fixed coaxially to the magazine guide roller 19 having the drive gear. The other sprocket wheel is coupled, via an endless chain 28, to a sprocket wheel fixed to a drive shaft of an electric motor 27 which is installed on the bottom portion of the base frame 10.

When an operator turns on the motor 27, the sprocket wheels fixed to the axis 25 are driven at the same time, via the endless chain 28, thereby and then the driving force is transmitted to each of drive gears 21, via the endless chain 26, the sprocket wheel and the magazine guide roller 19. Therefore, the driven gear 22 is driven by two drive gears 21, 21 to cause the magazine 20 rotate. It is also possible to drive the magazine 20 by operation of the manual handle 24 without turning on the motor. It is desirable to separate the handle 24 from the axis 25 by a clutch means (not shown) during when the motor 27 is driven.

Figure 4:
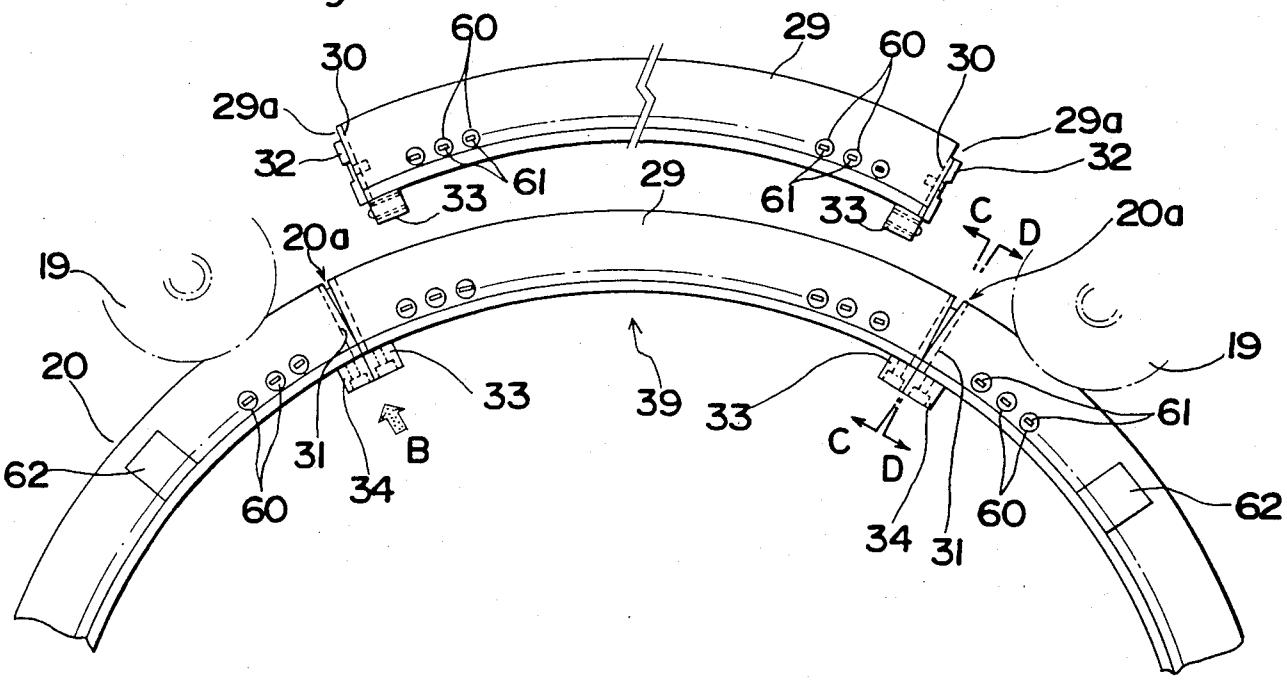
FIG. 4 is a front view of a portion of the magazine showing the segment mounted thereto.

The circular magazine 20 provides an arcuate segment 29 as a portion thereof which is detachable from the other portion as shown in FIG. 4.

Figure 5:
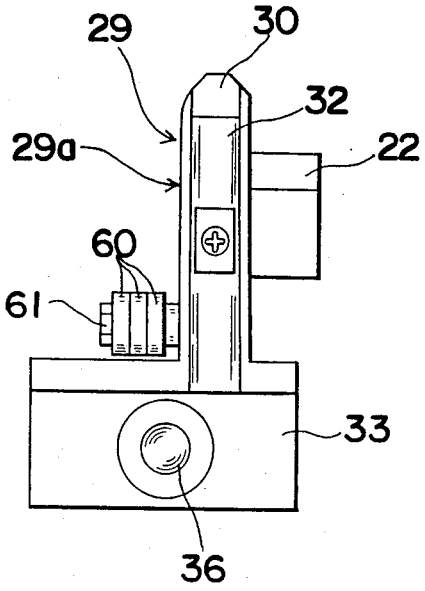
FIG. 5 is an end view of the segment seen from the line C—C.
Figure 6:
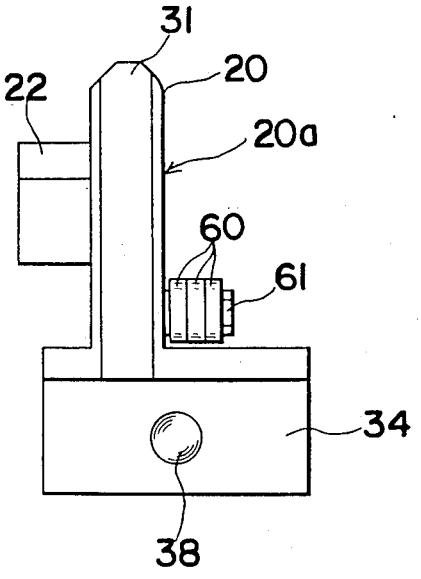
FIG. 6 is an end view of the magazine seen from the line D—D.

As shown in FIGS. 5 and 6, each end 29*a* of the segment 29 has a groove 30 formed throughout the whole height of the end face thereof in the radial direction of the magazine. Also, each end 20*a* of the rest of the magazine 20 has a groove 31 formed throughout the whole height thereof in the radial direction. On the groove 30 of the segment 29, a guide element 32 is mounted which is slidably engageable to the groove 31 of the end of the magazine 20 substantially in the radial direction. At respective end of the inner periphery of the segment 29 and of the rest of the magazine 20, a click-ball support member 33 and a receive plate member 34 are respectively fixed oppositely to each other. The click-ball support member 33 supports a click ball 36 so biased as to protrude therefrom by a coil spring (not shown) and the receive plate member 34 has a concave portion 38 for receiving the click ball 36 therein. Ball 36 and recess 38 comprise a click mechanism as is well known to those skilled in the art.

As is clear from the above discussion, it becomes possible to insert the magazine 20 into the central opening 1*a* of the magnetic core 1 by utilizing a space 39 formed when the segment 29 is detached. After the insertion of magazine 20, the segment 29 is pushed into the space 39 with aid of the guide member 32, 32 engaged into the grooves 31, 31 of the magazine 20 until each click ball 36 is caught into the concave 38 of the magazine 20. Thus, the entire circular magazine 20 is again formed.

As shown in FIG. 2, the turn table 14 is formed as a circular disk and three ball casters 40 are mounted on the under surface of the table. The table 14 is arranged under the separated portion 41 of the magazine stand 13 and is supported rotatably at its center by a drive shaft 43. A plurality of column-like holders 45 are erected at positions spaced along the periphery of the table with a predetermined pitch. The magnetic core 1 is supported and held by the upper ends of the holders 45 so that the axis of core 1 is vertical. The table 14 is operatable to rotate by a suitable angle in a range defined between two adjacent holders 45 and is fixed at a suitable angle by a stopper (not shown). Therefore, a number of coil units can be formed at positions different from each other along the arc portion of the core positioned between the adjacent holders.

Figure 7:
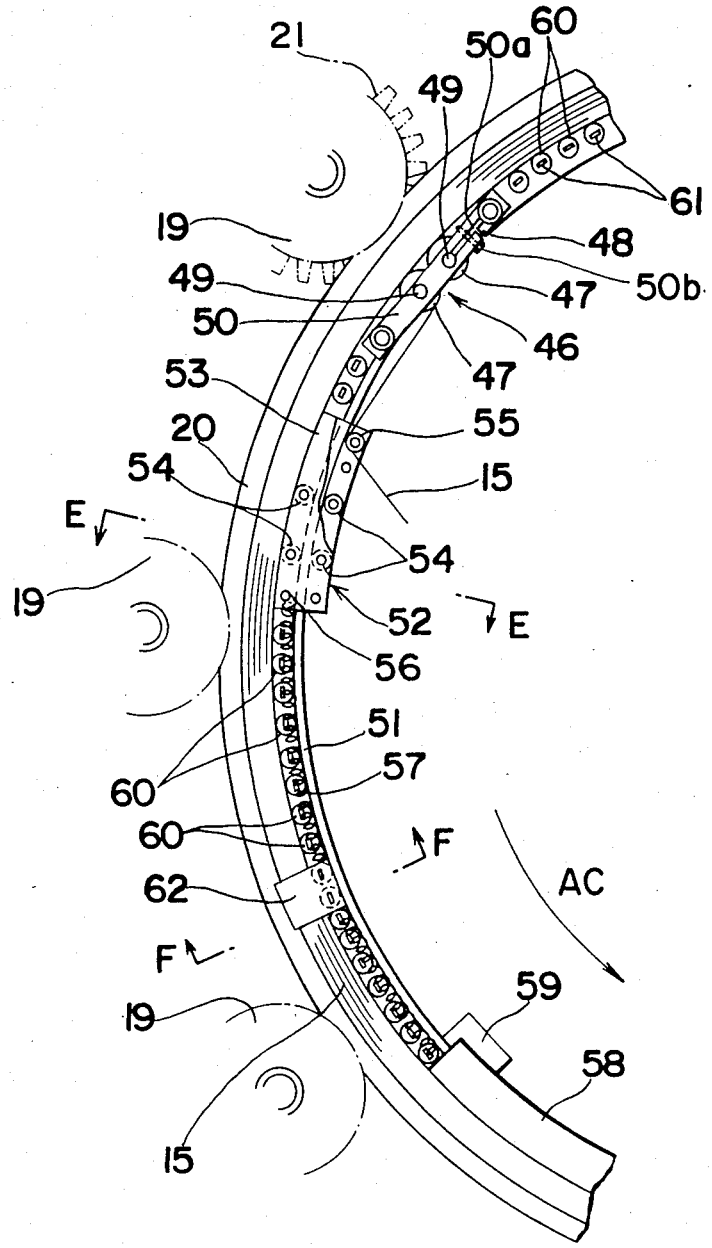
FIG. 7 is a front view of a portion of the magazine.

As is shown in FIG. 7, an aperture 46 of the magazine 20 for pulling out the strip 15 is defined by a pair of rollers 47 lined with rubber material which is provided as a brake means for applying a suitable friction force onto the strip upon pulling out. Specifically, the conductor 15 is squeezed between the outside circumferential surfaces of the rollers 47, 47 as the conductor is pulled from the magazine 20 toward the tension slider means 52. The braking mechanism further includes means to hold the rollers in different positions relative to each other. To elaborate, the braking mechanism includes a support plate 48 connected to the magazine 20 and having an elongated adjustment slot 50*a*; and a first roller shaft 49, which supports a first roller 47, is in turn supported by that support plate and extends through the adjustment slot.

The support plate 48 is flexible, or otherwise adjustable, so that it may be moved between an open position, in which the position of the first roller shaft 49 may be changed to change the position of the first roller 47, and a second position securely holding the first shaft in place in the adjustment slot 50*a*. With this embodiment, the means to hold the rollers 47, 47 in different positions also includes means for releasably holding the support plate 48 in that closed position, and this latter holding means may take the form of a screw 50*b* used, simply, to clamp or unclamp opposing legs of the support plate that form slot 50*a*.

Those of ordinary skill in the art will readily recognize numerous arrangements by which the position of the first roller 47 may be adjusted by changing the position of the first roller shaft 49 in the slot 50*a* of the support plate 48. For instance, the portion of the first shaft located in that slot may form a cam, or eccentric surface, such that rotation of that surface about the axis of the shaft, against the surfaces of plate forming slot 50*a*, moves the first roller slightly toward or slightly away from the second roller.

Figure 8:
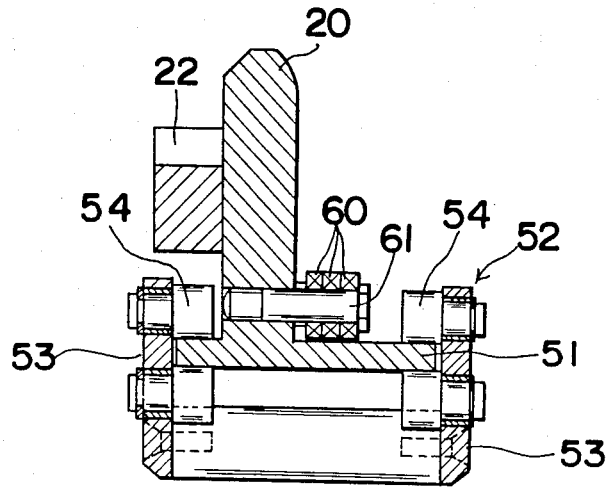
FIG. 8 is a sectional view along the line E—E of FIG. 7.

As is shown in FIG. 8, the inner peripheral portion of the magazine 20 is so widened in the direction of the axis thereof as to form a guide rail 51 for guiding a tension slider 52 slidably therealong. The tension slider 52 is comprised of a pair of side plates 53 disposed so as to put the guide rail 51 therebetween, and four rollers 54 supported by each side plate 53 so as to contact rotatably to the outer and inner surfaces of each edge portion of the rail respectively. As shown in FIG. 7, slide 52 further comprises a tension roller means 55 for hanging the strip pulled out from the aperture 46 therearound which is supported between the side plates 53 at the end thereof near to the aperture. At the other end of the slider 52, a pin 56 is provided. One end of a coil spring 57 spanned along the rail is fixed to the pin 56. The other end of the coil spring 57 is fixed to a pin (not shown) mounted on the magazine 20 at a position remote from the aperture 46 by a predetermined distance in the anticlockwise direction of FIG. 7. The side of the magazine where the coil spring 57 is arranged is covered with an arcuate side plate 58 except the range through which the tension slider 52 is slided. Further, a stopper means 59 is provided on the inner periphery of the rail 51 at a position near the trailing end of the side plate 58 which stops the tension slider 52 prior to the side plate 58 to prevent the collision therewith when the slider 52 is moved towards the side plate 58 by a spring force of the coil spring 57. A second spring 57, shown in FIG. 9, may also be connected to slider 52 and rail 20 to also urge the slider away from aperture 46.

Figure 9:
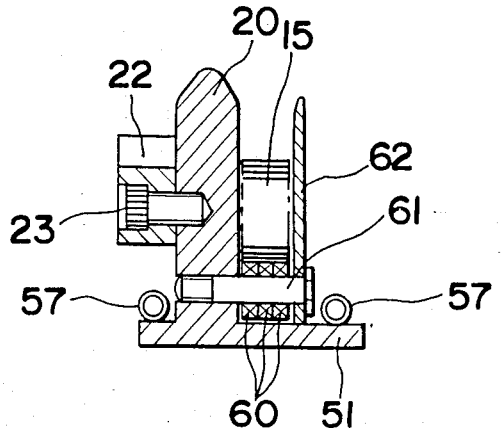
FIG. 9 is a sectional view along the line F—F of FIG. 7.

As is shown in FIG. 9, the guide rail 51 is formed wide at one side with respect to the main body of the magazine 20. The outer surface of the widened portion of the guide rail 51 is finished smoothly for winding the strip thereon to store it. A set of three bearings 60 is supported just above the outer surface of the guide rail 51 by a shaft 61 fixed to the lateral wall of the magazine 20 in a direction perpendicular thereto. A plurality of the set of bearings 60 are arranged along the rail 51 by a predetermined pitch in order to reduce a friction force which might be applied on the strip when it is wound directly around the rail 51. Further, a plurality of side support plates 62 are mounted to the magazine 20 by a predetermined pitch for supporting sides of turns of the strip wound up co-operatively with the lateral wall of the magazine to prevent slipping off of the strip in the axial direction of the magazine.

On forming coils around the trunk of the core with use of the toroidal winding apparatus, the segment 29 is taken off from the magazine to form the space 39 at first. Then, the magazine is so rotated manually to locate the space 39 in the space 41 defined between two ends of the C-shape magazine stand 13. Thereafter, the blank magnetic core 1 is inserted in a direction transversal to the space 41 and is set fixedly on the holders 45 of the turn table 14. After the set of the blank core, the magazine 20 is rotated to pass one end 20*a* of the magazine 20 through the opening 1*a* of the core and the segment 29 is restored to the space 39 to form the entire circular magazine. Next, the head of the strip having been wound around the feed drum 16 is pulled out therefrom unto the magazine 20 passing through the gap between the feed rollers 18 via the guide roller 17. The head of the strip having been pulled out is inserted inwards into the aperture 46 defined by two friction rollers 47 so as to project inwards by a short length therefrom. Thereafter, the motor 27 is turned on to rotate the magazine 20 anticlockwise, as shown by an arrow AC in FIG. 2. The magazine 20 is rotated by a predetermined number of revolutions to store the strip of a predetermined length. After winding the strip up, it is cut off at the position of the exit side of the paired feed rollers. The cut rear end of the strip is fixed onto the outermost turn of the strip having been wound around the magazine with use of an adhesive tape or the like. Thus, the operation for storing the strip in the magazine is completed.

The head tip of the strip having been pulled out inwards from the aperture 46 is pulled out further manually and is fixed onto a suitable position of the magnetic core 1 after suspending the strip over the guide means 55 of the tension slider 52.

Figure 10:
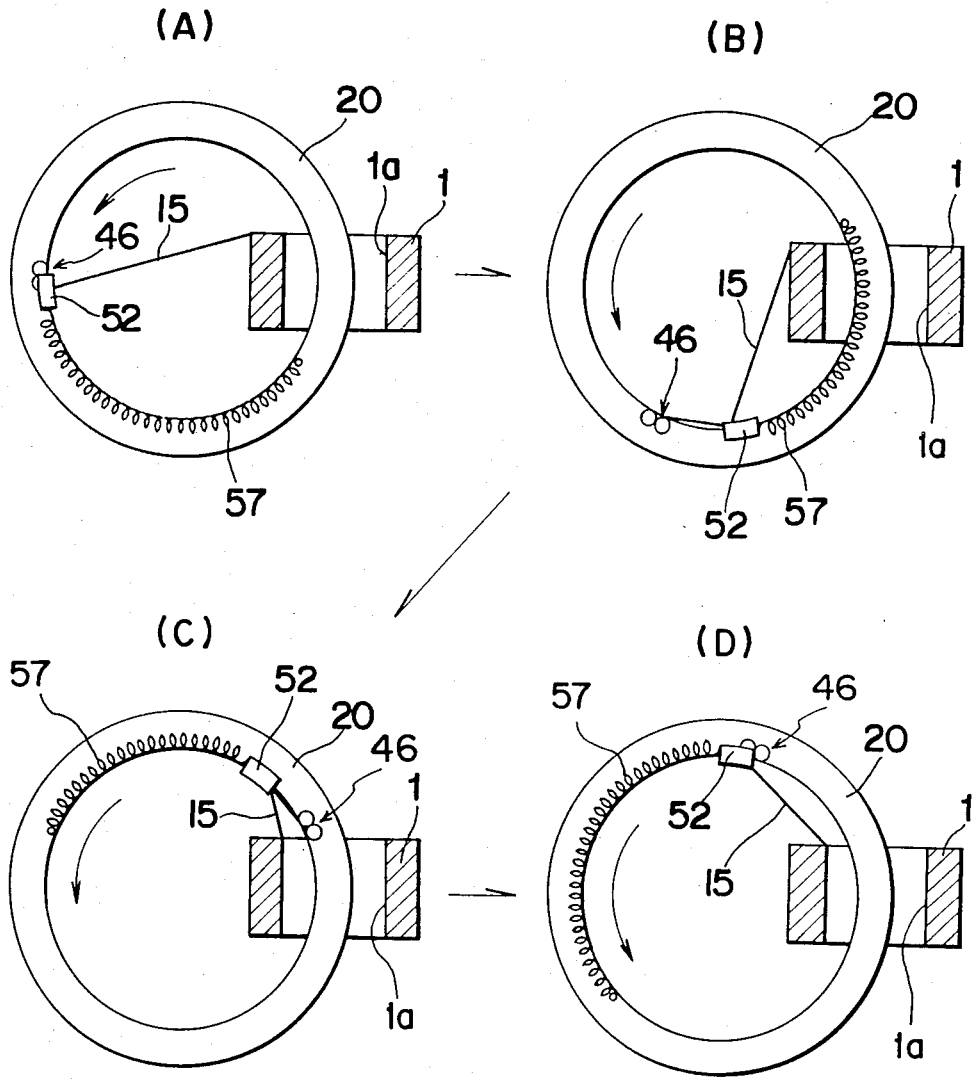
FIG. 10 (A) to (D) are views showing sequential winding motions of the magazine.

As shown in FIG. 10(A), it is desirable to fix the head tip of the strip in the state that the tension slider 52 is positioned at the position nearest to the aperture of the magazine which is so positioned at the position where the length of the strip spanned between the aperture 46 and the core 1 become longest.

After fixing the head tip of the strip onto the core, the magazine 20 is rotated anticlockwise as shown in FIG. 10(B). Although the strip between the aperture 46 and the core tends to become loose as the aperture 46 approaches the core 1, the strip is maintained in the state that a tension force adequate for preventing loosening thereof is applied thereto, since the tension slider 52 is always urged to move apart from the aperture 46 by the spring force of the coil spring 57.

During rotation subsequent to the state shown in FIG. 10(B), the aperture 46 and the tensron slider 52 pass through the window 1*a* of the core 1 and, therefore, the strip is pulled upwards passing through the window 1*a* as shown in FIG. 10(C). During this rotation of the magazine, the tension slider 52 is moved so as to absorb loosening of the strip according to a relative distance between the aperture and the core. It is to be noted that strip is not further pulled out from the magazine during the rotation from the position shown in FIG. 10(A) to the position shown in FIG. 10(C).

Upon further rotation of the magazine, the strip stored in the magazine is pulled out from the aperture as the distance between the aperture and the core is increased, as shown in FIG. 10(D). During this pulling out of the strip, each set of bearings 60 contacts to the portion of the strip just pulled out, and guides the same smoothly by the rotation thereof. The pulling out of the strip is completed when the aperture is returned to the position shown in FIG. 10(A). Thus, one turn of the coil is wound up around the trunk of the core tightly. The winding motion just mentioned above is repeated until a unit coil having a predetermined number of turns is formed. When a unit coil is wound up, the strip is cut off at a position near the unit coil and the tip end cut off is fixed onto the outermost turn of the unit coil with use of an adhesive tape.

Figure 11:
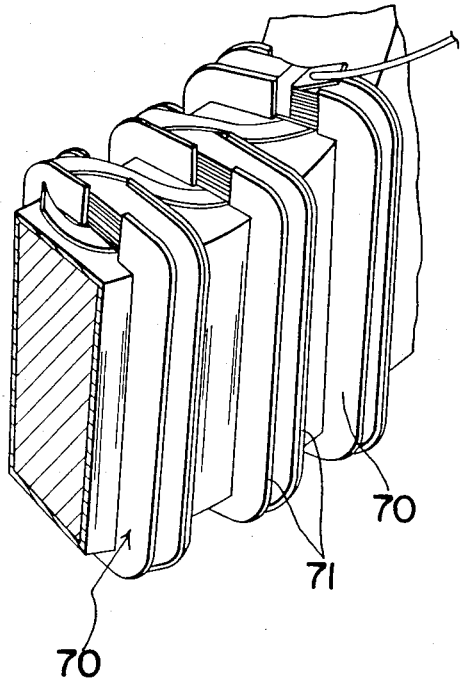
FIG. 11 is a partial perspective view of a toroidal core showing a primary winding formed with a strip.

Thereafter, the turn table 14 is rotated about the axis 43 by a predetermined angle together with the core and another unit coil is formed, in the same manner as mentioned above, at a position circumferentially spaced from the position where the unit coil having been formed. Thus, unit coils of a predetermined number are formed along the circumference of the core spaced from each other. These unit coils are connected according to a predetermined manner. For instance, a toroidal winding is formed when unit coils are connected in series as shown in FIG. 11. In order to prevent the collapse of a unit coil, which may happen during winding thereof, it is desirable to use a bobbin 70 with side ribs 71 as is shown in FIG. 11.

If in the case that all of the unit coils of a predetermined number are not formed in a range of rotation through which the turn table can be rotated, winding operation can be continued after rotating the core on the holders in a circumferential direction thereof.

According to the preferred embodiment of the present invention, there are obtained many advantages as follows;

(a) The strip is wound under a tension force sufficient for forming a compact and tight coil, since the strip portion between the aperture and the core is kept taut by the tension slider without depending on the position of rotation of the magazine.

(b) Friction forces between adjacent turns of the strip stored in the magazine are not developed, since the strip is unwound from the inner turn and, therefore, the coil of the strip stored in the magazine is gradually loosened. Moreover, upon pulling out the strip stored in the magazine, the strip is guided by bearing means arranged along the inner periphery of the magazine. Therefore, all of the coils are wound under a stable and constant tension force.

(c) Since the driven gear is provided integrally on one side of the magazine, the width of the magazine in the radial direction can be reduced. Due to this, it becomes possible to reduce the inner radius of the core and, therefore, to reduce the weight of the core.

(d) The segment can be detached or restored by one-touch, since the guide means and click means are provided for the segment.

It is to be appreciated that various modifications may be implemented with respect to the above described preferred embodiment. The strip as a conduction may be altered to a wire having a circular or rectangular section. The core can have a configuration other than toroidal, for example, an oval, rectangular, square or the like configuration.

Having thus described the invention in rather full detail, it will be understood that these details need not be strictly adhered to, but that various changes or modifications may suggest themselves to those skilled in the art, all falling within the scope of the invention as defined by the claims.

What is claimed is:

1. A toroidal winding apparatus for winding an elongated conductor into a coil around a magnetic core having a central opening, comprising:

a circumferentially extending magazine for storing the conductor around the outer periphery thereof, and including an inside opening to pass the conductor radially inward;

a magazine stand supporting the magazine for rotation along a circumferential path of travel, and including an opening to receive the magnetic core in a position where the path of travel of the magazine extends through the central opening of the magnetic core;

means to rotate the magazine around the path of travel, to pass the conductor from the magazine, through the inside opening, and to wind the conductor around the magnetic core;

tension slider means supported for movement along the magazine to engage and to maintain tension on the conductor, between the magazine and the magnetic core, as said conductor is wound onto the magnetic core; and braking means connected to the magazine for rotary movement therewith to apply a braking force to the conductor as said conductor passes from the inside opening of the magazine toward the tension slider means; the braking means comprising (i) a first roller having a first outside circumferential surface, (ii) a second roller having a second outside circumferential surface, and (iii) means to hold the first and second circumferential surfaces in different positions relative to each other, the first and second rollers being positioned opposite each other to squeeze the conductor between the first and second outside circumferential surfaces as the conductor is pulled from the magazine toward the tension slider means.

2. A toroidal winding apparatus according to claim 1, wherein:

the means to hold the first and second circumferential surfaces in different positions includes (i) a support plate connected to the magazine and having an adjustment slot, and (ii) a first shaft supported by the support plate, extending through the adjustment slot, and rotatably supporting the first roller;

the support plate is moveable between an open position, wherein the position of the first shaft in the adjustment slot may be changed to change the position of the first roller, and a closed position, wherein the first shaft is securely held in place in the adjustment slot; and the means to hold the first and second circumferential surfaces in different positions further includes (iii) means releaseably holding the support plate in the closed position.

3. A toroidal winding apparatus for winding an elongated conductor into a coil around a magnetic core having a central opening, comprising:

a circumferentially extending magazine for storing the conductor around the outer periphery thereof, and including (i) an inside opening to pass the conductor radially inward, (ii) an axially and circumferentially extending guide rail, (iii) a plurality of bearings circumferentially spaced apart along an outside surface of the guide rail to support the conductor on the magazine, and (iv) side retainer means radially extending outward from the guide rail, on opposite axial sides of the bearings, and forming, with the bearings, a conductor holding channel to receive and hold the conductor;

a magazine stand supporting the magazine for rotation along a circumferential path of travel, and including an opening to receive the magnetic core in a position where the path of travel of the magazine extends through the central opening of the magnetic core;

means to rotate the magazine around the path of travel, to pass the conductor from the magazine, through the inside opening, and to wind the conductor around the magnetic core;

tension slider means supported from movement along the magazine to engage and to maintain tension on the conductor, between the magazine and the magnetic core, as said conductor is wound onto the magnetic core, the tension slider means including (i) a side plate located adjacent a first axial end of the guide rail, and projecting radially outward and radially inward thereof, (ii) a first pair of spaced rollers connected to and axially extending from the side plate, and engaging opposite radial sides of the guide rail to slidably mount the tension slider means thereon, and (iii) a second pair of rollers circumferentially spaced along the guide rail from the first pair of rollers, the second pair of rollers being spaced apart from each other, connected to and axially extending from the side plate, and engaging the opposite radial sides of the guide rail to further slidably hold the tension slider means thereon; and braking means connected to the magazine for rotary movement therewith to apply a braking force to the conductor as said conductor passes from the inside opening of the magazine toward the tension slider means.

4. A toroidal winding apparatus according to claim 3 wherein:

the tension slider means further includes a spring supported on and circumferentially extending along the outside surface of the guide rail, the spring having a first end connected to the magazine to urge the tension slider means away from the inside opening of the magazine; and the side retainer means axially separates the spring from the conductor holding channel.

* * * * *